US006672232B2

(12) United States Patent
Enns et al.

(10) Patent No.: US 6,672,232 B2
(45) Date of Patent: Jan. 6, 2004

(54) TWO-THREAD LOCK-STITCH SEWING MACHINE WITH THREAD CUTTER

(75) Inventors: Johann Enns, Oerlinghausen (DE); Andreas Riffel, Bielefeld (DE)

(73) Assignee: Durkopp Adler Aktiengesellschaft (DE)

( * ) Notice: Subject to any disclaimer, the term of this patent is extended or adjusted under 35 U.S.C. 154(b) by 74 days.

(21) Appl. No.: 10/103,375

(22) Filed: Mar. 21, 2002

(65) Prior Publication Data

US 2002/0166487 A1 Nov. 14, 2002

(30) Foreign Application Priority Data

May 11, 2001 (DE) ..... 101 23 075

(51) Int. Cl.[7] ..... D05B 65/00

(52) U.S. Cl. ..... 112/291

(58) Field of Search ..... 112/291, 292, 112/294, 298, 297, 300, 295

(56) References Cited

U.S. PATENT DOCUMENTS

| | | | | |
|---|---|---|---|---|
| 3,211,117 A | | 10/1965 | Speichermann | |
| 3,658,021 A | | 4/1972 | Hedegaard et al. | |
| 4,586,449 A | * | 5/1986 | Raupach | 112/292 |
| 5,964,170 A | | 10/1999 | Gries | |

* cited by examiner

*Primary Examiner*—Peter Nerbun
(74) *Attorney, Agent, or Firm*—Robert F. I. Conte; Barnes & Thornburg

(57) ABSTRACT

A two-thread lock-stitch sewing machine with a thread cutter comprises a shaft which is parallel to the vertical axis of a shuttle and has a lever arm with a thread pulling knife disposed on it. The bobbin case in the shuttle has a holding finger which is directed toward a stitch hole and is held between two cams that are arranged on a rib. Formed between the cams and the workpiece bearing plate is an interspace which the lever arm passes through, together with the thread pulling knife projecting into a space between the motion travel of the sewing needle and the cams so that a thread cutting operation is enabled to be performed with very short thread tail pieces remaining on the lower side of the workpiece. The thread cutting operation excels by simple design and reliable operation.

5 Claims, 3 Drawing Sheets

TWO-THREAD LOCK-STITCH SEWING MACHINE WITH THREAD CUTTER

BACKGROUND OF THE INVENTION

1. Field of the Invention

The invention relates to a two-thread lock-stitch sewing machine with a thread cutter, comprising the following features: a bearing plate for a workpiece; a stitch hole formed in the bearing plate or in the feeder for a sewing needle to pass through that carries a needle thread and reciprocates up and down along a motion travel; a bearing block is arranged underneath the bearing plate, having a shuttle rotatably lodged in it; the shuttle has a shuttle body that rotates about a vertical axis with a bobbin case rotatably accommodated therein inclusive of shuttle thread supplies; two stationary cams which are disposed in proximity to the stitch hole and a holding finger which is provided on the bobbin case and has an end located between the cams; the thread cutter with a thread pulling knife, which is movable to reciprocate between a swung-out position and a swung-in position, performing a cutting motion in an x-y plane that extends at right angles to the axis, which comprises a hook, which seizes the threads, and a cutting edge, and which, in the swung-in position, is movable into a space between the motion travel and the cams.

2. Background Art

A two-thread lock-stitch sewing machine of the generic type is known from U.S. Pat. No. 3,658,021. The thread cutter comprises a thread pulling knife pivotable in a plane that extends at right angles to the vertical axis of rotation of the shuttle. For a thread cutting process to take place, in which short tail pieces of the needle and shuttle threads remain on the lower side of the workpiece, a catch thread device and a cutting knife are moved in opposite directions, with the motion travel of the catch thread device being between the motion travel of the needle and the holding finger of the bobbin case.

The fact that the thread puller and the cutting knife are formed on the ends of sectors of an annulus demands for a complicated bearing arrangement. Additionally, this kind of a thread cutter needs a special drive mechanism. All this leads to an overall construction that is accompanied with a considerable manufacturing cost and consists of a considerable number of components, by which to achieve a mode of operation of only limited durability and reliability.

U.S. Pat. No. 3,211,117 teaches a thread cutter for sewing machines, in which a thread pulling knife is formed on the elbowed ends of a lever arm which is tightly united with a pivot axis that is parallel to the vertical axis of rotation of the shuttle. When a cutting motion is performed, the thread pulling knife is positioned in its swung-in position between the bobbin case and the holding finger that is disposed thereon. Due to this arrangement, the thread pulling knife finds itself at a comparatively great distance from the stitch hole so that tail pieces of a length of some millimeters are inevitable on the lower side of the workpiece after the needle and the shuttle threads have been cut.

SUMMARY OF THE INVENTION

It is an object of the invention to further develop the known two-thread lock-stitch sewing machine in such a way that a durably reliable mode of operation is attained, which is accompanied with a decrease in the manufacturing cost of the thread cutter.

This object is attained in the two-thread lock-stitch sewing machine by the following features: the thread pulling knife is formed on the free end of a lever arm which is connected to a shaft that is parallel to the axis, and which is movable above the bobbin case; the cams are disposed on a rib, which has an upper surface that is substantially parallel to the x-y plane; the bearing plate is provided with a lower surface that is substantially parallel to the x-y plane, with the lower surface and the upper surface being disposed at a distance from each other that is measured at right angles to the x-y plane, forming an interspace for the lever arm to pass through unimpeded for the performance of the cutting motion.

Providing an interspace between the cams that safeguard the bobbin case against rotation and the workpiece bearing plate enables a familiar thread pulling knife of simple structure to be used, which can be produced at a low cost and which, in the swung-in position with the to-be-cut threads seized, can be positioned in a space between the motion travel of the sewing needle and the cams. Simultaneously, the arrangement according to the invention helps achieve additional guidance of the thread pulling knife, which facilitates cutting jobs of thicker threads of a diameter exceeding 0.3 millimeters. The two-thread lock-stitch sewing machine and the thread cutter according to the invention are characterized by a durably reliable mode of operation.

The further development, according to which the rib is formed in the way of a bilaterally clamped support, permits rigid mounting of the rib that is provided with the cams. This has the further advantage that the workpiece bearing plate, with the cams missing on its lower side, may be produced from sheet material and thus at a lower cost. The effect of this cost advantage is even stronger when the bearing plate is provided with a stitch hole and thus subject to special wear.

The embodiment, according to which the plate and the bearing plate are provided with congruent drilled holes for the reception of fastening screws, enables the bearing plate and the plate that is provided with the cams to be fastened by the same fastening screws, precluding any additional measures for fixing the two plates. The further development, according to which the rib is formed on the workpiece bearing plate, results in a more rigid construction. Furthermore, integrating two components leads to reduced manufacturing costs and simplified handling during maintenance and repair. An advantageous further development is attained by the rib being formed in the way of a bilaterally clamped support.

Details of the invention will become apparent from the ensuing description of exemplary embodiments, taken in conjunction with the drawing.

DESCRIPTION OF PREFERRED EMBODIMENTS

Figure 1:
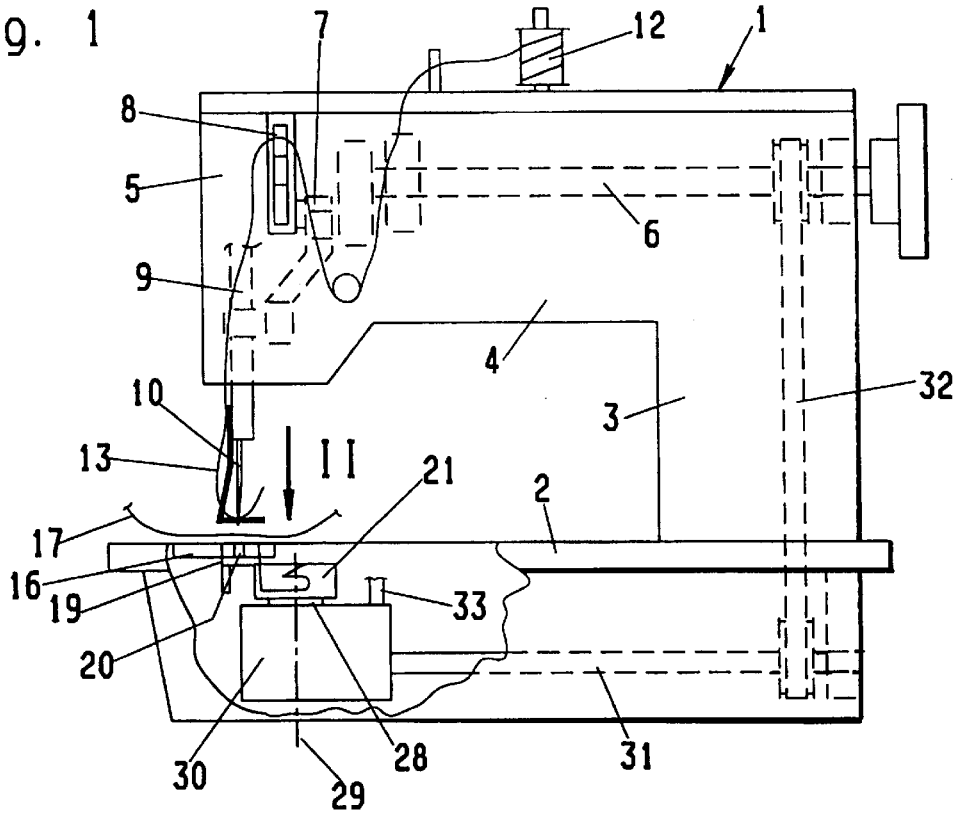
FIG. 1 is an elevation of a sewing machine.
Figure 4:
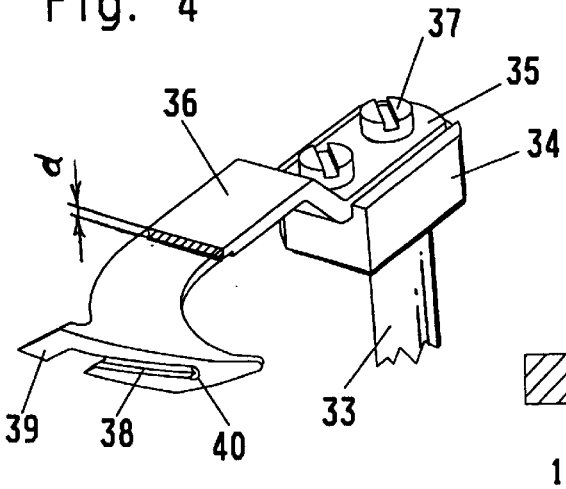
FIG. 4 is a perspective view of the lever arm shown in FIGS. 2 and 3.

A sewing machine 1 comprises a base plate 2 with a standard 3 extending upwards therefrom and an elbowed arm 4 which terminates in a head 5. An arm shaft 6 is rotatably lodged in the arm 4, actuating, in the head 5, a crank drive 7 with a thread lever 8. The crank drive 7 is in driving connection with a needle bar 9 which is housed for displacement in the head 5, having a sewing needle 10 at its lower end. Consequently, the sewing needle 10 is movable by the crank drive 7 to reciprocate up and down, with the sewing needle 10 passing through a motion travel 11. In an eye, the sewing needle 10 carries a thread which is supplied from a bobbin 12 via a thread tightener and the thread lever 8 and which is designated hereinafter as the needle thread 13.

Positioned on the base plate 2 is a bearing plate 16 which is fastened by screws 14, 15 and has a workpiece 17 resting on it. The bearing plate 16 is equipped with a recess 18 for a feeder 19 to reach through. The feeder 19 has a stitch hole 20 for the sewing needle 10 to pass through, which is customary in so-called needle-feed sewing machines. The feeder 19 is in driving connection with a sliding and lifting transmission underneath the base plate 2, which is conventional and familiar.

Located below the bearing plate 16 is a shuttle 21 which has shuttle body 22 and a beak 23. A cup-shaped bobbin case 24 is rotatably mounted in the shuttle body 22, taking up thread supplies 25. This is from where a piece of a thread runs through an outlet 26, which is designated hereinafter as the shuttle thread 27. From the outlet 26, this shuttle thread 27 reaches through the stitch hole 20.

The shuttle body 22 is tightly joined to a shaft 28, which has a vertical axis 29 extending parallel to the needle bar 9. The shaft 28 is mounted for rotation in a bearing block 30 that is screwed on the base plate 2. A drive shaft 31 is housed in this bearing block 30 and is joined to a gear transmission that is disposed inside the bearing block 30. Via a belt drive 32, the drive shaft 31 is in driving connection with the arm shaft 6.

Further, a shaft 33, which is parallel to the shaft 28, is rotatably housed in the bearing block 30. At its upper end that extends out of the bearing block 30, the shaft 33 is provided with a flange 34, to which is fastened an end 35 of a arched lever arm 36 by means of screws 37. On its free end, the lever arm 36 has an elbowed piece that forms a thread pulling knife 38. This has a hook 39 and a cutting edge 40.

Figure 2:
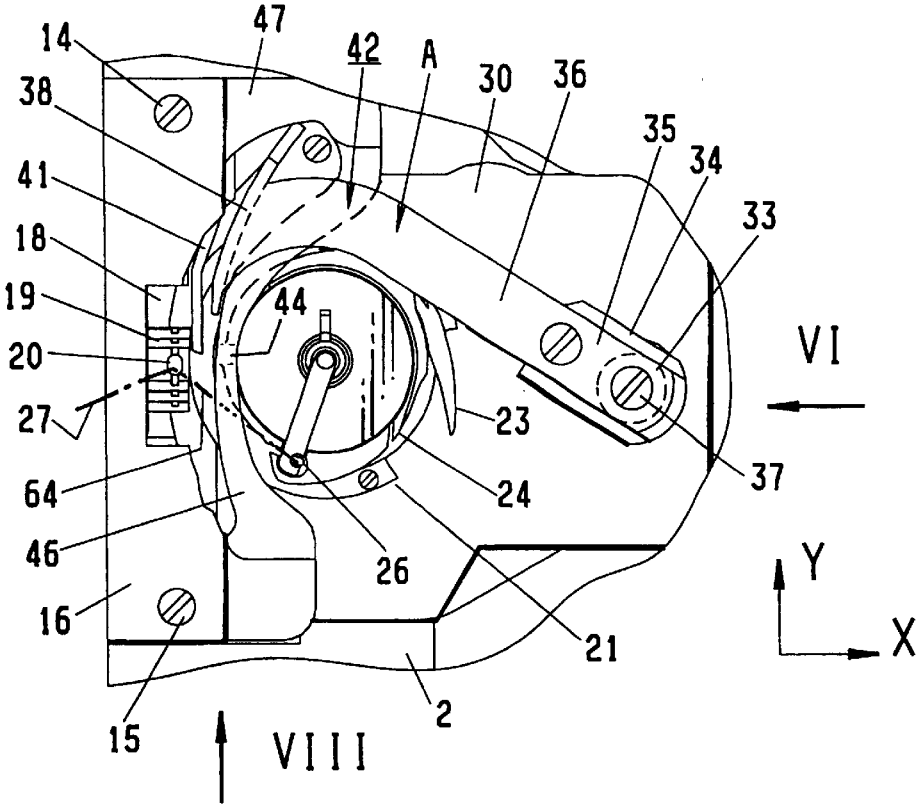
FIG. 2 is a plan view, on an enlarged scale, of a portion of the sewing machine in accordance with the arrow II of FIG. 1, with a lever arm of a thread cutter being shown in a swung-out position.
Figure 3:
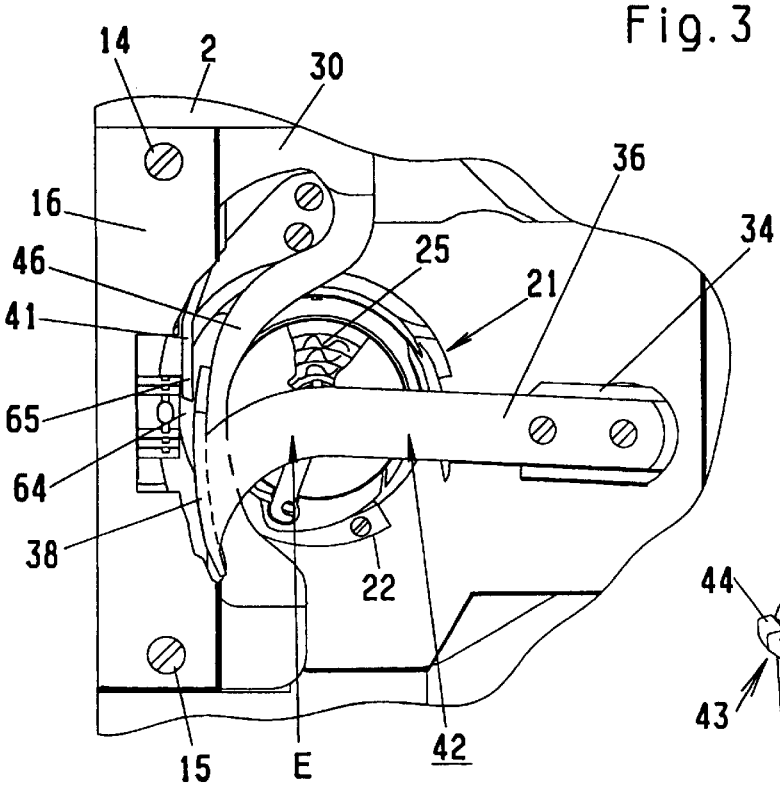
FIG. 3 is a view, corresponding to FIG. 2, with the lever arm of the thread cutter being shown in a swung-in position.
Figure 7:
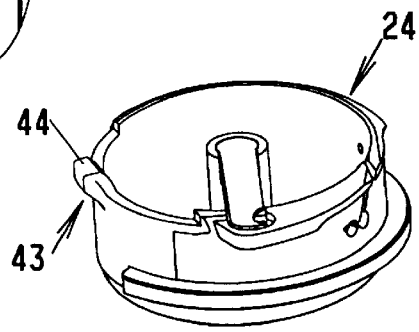
FIG. 7 is a perspective view of a bobbin case on an enlarged scale.
Figure 5:
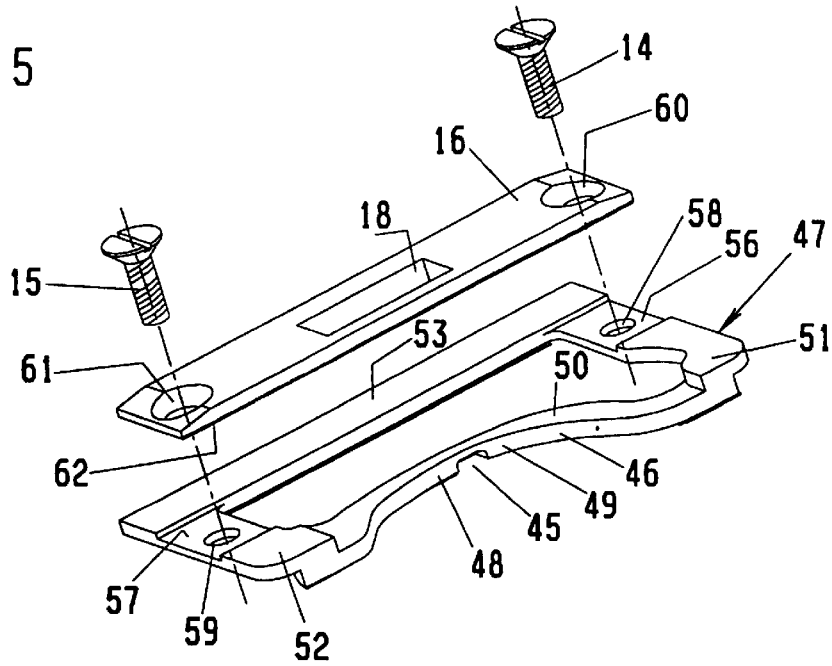
FIG. 5 is a perspective explosive view of a workpiece bearing plate and a holding plate.

Via the shaft 33, the lever arm 36, together with the thread pulling knife 38, is in driving connection with a driving mechanism (not shown) that is also disposed on the bearing block 30. The driving mechanism is such that the lever arm 36 is pivoted between a swung-out position A (FIG. 2) and a swung-in position E (FIG. 3). As a result of this arrangement, the lever arm 36 performs a working motion corresponding to x-y directions in an x-y plane that is at right angles to the axis 29. Mounted on the bearing block 30 is a stationary thread clamping knife 41 which comes into contact with the thread pulling knife 38 upon execution of the working motion. The lever arm 36, together with the thread pulling knife 38, the thread clamping knife 41 and the mentioned driving mechanism are components of a thread cutter 42.

The arrangement and design of the bearing block 30 with the mentioned gear transmission, the driving connection with the arm shaft 6 as well as the thread cutter 42 specified so far are known from DE 25 40 994 A1 and from a commercial Adler class 467 sewing machine with the associated list of spare parts.

Figure 8:
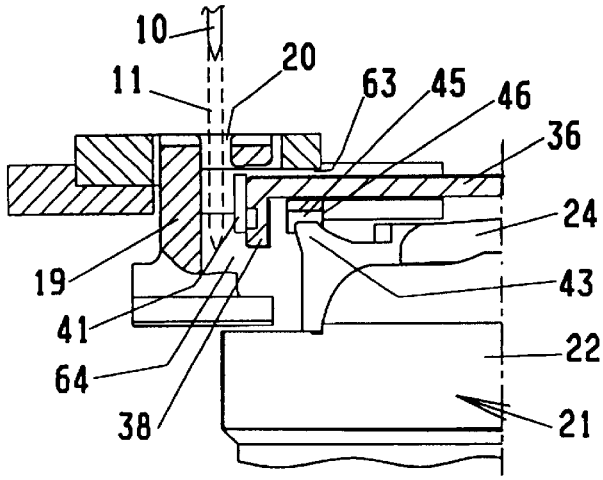
FIG. 8 is an enlarged illustration, in the direction of the arrow VIII of FIG. 2, of components that are essential for the invention, with portions of the components being shown in section.

Conventionally, the bobbin case 24 is equipped with a holding finger 43 which has an end 44. As seen in FIG. 8, the end 44 projects into a recess 45 on a rib 46 of a holding plate 47. The recess 45 encompasses the end 44 by three edges, each by a clearance of approximately 0.5 millimeters. The recess 45 is defined by cams 48, 49. Further, the rib 46 is provided with an upper surface 50 that extends substantially parallel to the x-y plane. At both ends, the rib 46 terminates in tabs 51 and 52 which are interconnected by way of a connection piece 53. The rib 46 that interconnects the tabs 51, 52 is formed in the way of a bilaterally clamped support. Formed on the tabs 51, 52 are surfaces 54, 55 which are in mutual alignment. Further, screw-down surfaces 56, 57 are provided on the tabs 51, 52, having drilled holes 58, 59.

Figure 6:
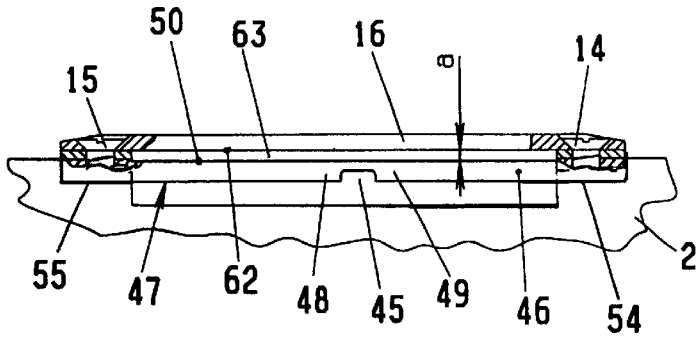
FIG. 6 is a view, rotated clockwise by 90°, in the direction of the arrow VI of FIG. 2 on the workpiece bearing plate and the holding plate in the mounted condition.

As seen in FIG. 6, the holding plate 47 and the bearing plate 16, which is provided with drilled holes 60, 61 that align with the drilled holes 58, 59 of the holding plate 47, are jointly screwed on the base plate 2 by means of the screws 14, 15. The bearing plate 16 rests by its lower surface 62 on the screw-down surfaces 56, 57. Special attention is drawn to the fact that the surfaces 50, 56, 57, 62 as well as the screw-down surfaces (without reference numerals) for the holding plate 47 that bear on the base plate 2, are substantially parallel to the x-y plane. The design of the holding plate 47 and the bearing plate 16 helps create an interspace 63 which is defined by the upper surface 50 and the lower surface 62 and which is parallel to the x-y plane. The interspace 63 is dimensioned such that the lower surface 62 and the upper surface 50 are disposed at a distance a from each other of approximately 2.5 millimeters measured at right angles to the x-y plane.

The lever arm 36 is made of high strength sheet metal of a thickness d of approximately 2 millimeters so that the lever arm 36 reaches with play through the interspace 63. Thus, the thread pulling knife 38 projects into a space 64 between the rib 46 and the motion travel 11 of the sewing needle 10 (FIG. 8). The lever arm 36, which passes through the interspace 63, is guided on the surfaces 50. 62 in a direction that runs at right angles to the x-y plane. Consequently, the thread pulling knife 38 experiences stable guidance in the vicinity of its cutting area, which facilitates the cutting of thicker threads of a diameter of more than 0.3 millimeters.

Figure 9:
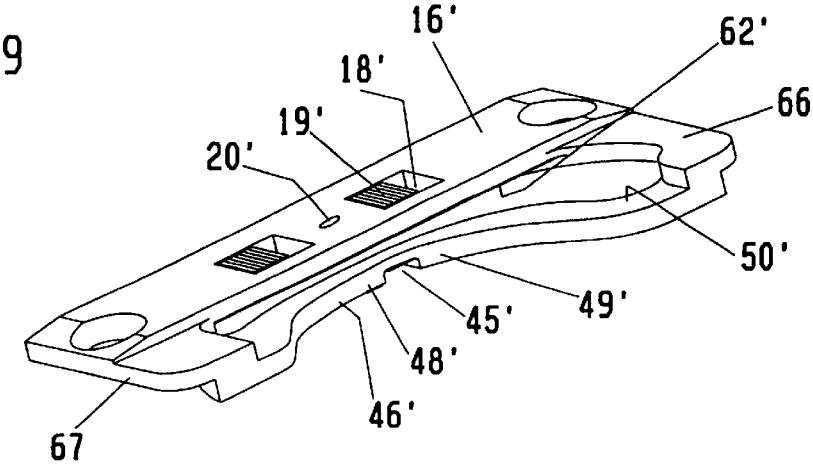
FIG. 9 is a perspective view of a one-piece component with a workpiece bearing plate and a holding plate.

FIG. 9 illustrates a bearing plate that is made from one piece with a rib formed thereon. For reasons of clarity, in the ensuing specification, corresponding parts have the same reference numerals provided with a prime.

A bearing plate 16' is provided with a stitch hole 20' as is necessary in sewing machines with a sewing needle that is stationary in the direction of workpiece feed. Further, the bearing plate 16' is provided with a recess 18' for a feeder 19' to reach through. The bearing plate 16' comprises the tabs 66, 67 which are interconnected by a rib 46'. Cams 48' and 49' are provided on the rib 46' same as on the rib 46, defining between themselves a recess 45'. As in the construction described above, here too a lower surface 62' of the bearing plate 16' and an upper surface 50' of the rib 46' are at a distance a of approximately 2.5 millimeters from each other measured at right angles to the x-y plane so that here too fulfillment is achieved of the function of the structure that is composed of the bearing plate 16 and of the holding plate 47.

The mode of operation of the two-thread lock-stitch sewing machine is as follows:

During the sewing operation, the lever arm 36 is in the swung-out position A, which may also be called the position of rest. At the end of a seam, signal input to a machine control unit is performed by the operator for a thread cutting operation to take place. After reduction of the speed of the sewing machine 1, the machine control unit causes the lever arm 36 to be pivoted from the swung-out position A into the swung-in position E, which is effected via the drive mechanism of the thread cutter 42. In this case, the thread pulling knife 38 moves past the threads that run from the shuttle 21 to the stitch hole 20 (shuttle thread 27 and two strands of the needle thread 13). Then the lever arm 36 is pivoted from the swung-in position E into the swung-out position A. The shuttle thread 27 and the strand of the needle thread 13 that runs towards the workpiece 17 are seized and severed in the proximity of the lower side of the stitch hole 20 by the cutting edge 40 cooperating with a cutting edge 65 on the stationary thread clamping knife 41.

The described mode of operation of the thread pulling knife 38 in combination with the thread clamping knife 41 for seizing the threads 13, 27 as well as severing them and clamping the tail piece of the shuttle thread 27 that extends from the thread supplies 25 is prior art.

Providing the interspace 63 enables the lever arm 36 known per se and the thread pulling knife 38 attached thereto to be used in such a way that the thread pulling knife 3 8 can be moved very close to the motion travel 11 of the sewing needle 10 in the space 64. In combination with the cutting edge 65, also projecting into this space 64, of the stationary thread clamping knife 41, a thread cutting operation may be performed, in which the thread tail pieces that remain on the lower side of the workpiece 17 are comparatively short i.e., they have a length of approximately 3 to 6 millimeters.

What is claimed is:

1. A two-thread lock-stitch sewing machine, comprising:

a sewing needle (10), which carries a needle thread (13) and is movable to reciprocate up and down along a motion travel (11);

a bearing plate (16; 16') for a workpiece (17);

a feeder (19; 19');

a stitch hole (20; 20') formed in one of the bearing plate (16; 16') and the feeder (19; 19') for the sewing needle (10) to pass through;

a shuttle (21), which is arranged underneath the bearing plate (16; 16') and rotatably lodged in a bearing block (30), and which has a shuttle body (22), which is rotatable about a vertical axis (29) and which is provided with a rotatable bobbin case (24) and supplies (25) of a shuttle thread (27);

two stationary cams (48, 49; 48', 49'), which are disposed in proximity to the stitch hole (20; 20');

a holding finger (43), which is provided on the bobbin case (24) and has an end (44) located between the cams (48, 49; 48', 49');

a thread cutter (42) with a thread pulling knife (38), which is movable to reciprocate between a swung-out position (A) and a swung-in position (E), performing a cutting motion in an x-y plane that extends at right angles to the vertical axis (29), which comprises a hook (39), which seizes the threads (13, 27), and a cutting edge (40), and which, in the swung-in position (E), is movable into a space (64) between the motion travel (11) and the cams (48, 49; 48', 49');

wherein the thread pulling knife (38) is formed on the free end of a lever arm (36) which is connected to a shaft (33) that is parallel to the vertical axis (29), and which is movable above the bobbin case (24);

wherein the cams (48, 49; 48', 49') are disposed on a rib (46; 46'), which has an upper surface (50; 50') that is substantially parallel to the x-y plane; and wherein the bearing plate (16; 16') is provided with a lower surface (62; 62') that is substantially parallel to the x-y plane, with the lower surface (62; 62') and the upper surface (50; 50') being disposed at a distance (a) from each other that is measured at right angles to the x-y plane, forming an interspace (63) for the lever arm (36) to pass through unimpeded for the performance of the cutting motion.

2. A two-thread lock-stitch sewing machine according to claim 1, wherein the rib is formed as a bilaterally clamped support.

3. A two-thread lock-stitch sewing machine according to claim 2, wherein the plate (47) and the bearing plate (16) are provided with congruent drilled holes (58, 59; 60, 61) for the reception of fastening screws (14, 15).

4. A two-thread lock-stitch sewing machine according to claim 1, wherein the rib (46') is formed on the bearing plate (16').

5. A two-thread lock-stitch sewing machine according to claim 4, wherein the rib (46') is formed as a bilaterally clamped support.

* * * * *